United States Patent [19]

Reimer

[11] Patent Number: 4,934,595

[45] Date of Patent: Jun. 19, 1990

[54] METHOD AND APARATUS FOR SPRAY COATING

[75] Inventor: James H. Reimer, Alvin, Tex.

[73] Assignee: Plastic Flamecoat Systems, Inc., League City, Tex.

[21] Appl. No.: 234,178

[22] Filed: Aug. 19, 1988

[51] Int. Cl.[5] ..... B05C 5/04

[52] U.S. Cl. ..... 239/8; 239/79; 239/85; 239/422; 239/424; 239/428; 118/47; 427/423

[58] Field of Search ..... 239/422, 423, 424, 424.5, 239/428, 79, 85, 80, 8; 118/47, 302; 427/223, 225, 423

[56] References Cited

U.S. PATENT DOCUMENTS

| | | | |
|---|---|---|---|
| 2,544,259 | 3/1951 | Duccini et al. | 239/79 |
| 2,594,222 | 4/1952 | Sandora et al. | 239/85 |
| 2,643,955 | 6/1953 | Powers et al. | 239/85 |
| 3,073,528 | 1/1963 | Wilson et al. | 239/79 |
| 3,415,450 | 12/1968 | Hawk, Sr. | 239/85 |
| 3,441,215 | 4/1969 | Cape | 239/85 |
| 3,442,454 | 5/1969 | Stenger et al. | 239/85 |
| 4,632,309 | 12/1986 | Reimer | 239/8 |

FOREIGN PATENT DOCUMENTS

| | | | |
|---|---|---|---|
| 197708 | 8/1977 | U.S.S.R. | 239/79 |

*Primary Examiner*—Andres Kashnikow
*Assistant Examiner*—Christopher G. Trainor
*Attorney, Agent, or Firm*—Kirk, Bissex & Lindsay

[57] ABSTRACT

In an open-atmosphere flame spray gun system for spraying molten particulate material and a method of spray application, an improved eductor mechanism and flame spray gun permits a greater quantity of particulate material to be delivered to the article to be coated. The particulate material entrained in a stream of pressurized conveying air, a stream of pressurized burn/propelling air and a stream of fuel gas are delivered through a plurality of passageways extending through the gun body to a combustion chamber for mixing and ignition. The streams are delivered in concentric annular relationship to the combustion chamber, with the stream of particulate material and conveying air and concentric annular stream of burn/propelling air being directed into the combustion chamber in an outwardly expanding conically-shaped axial cross-section for enhancing the diameter and length of the flame produced by the gun and permitting an increased quantity of particulate material to be melted and delivered for coating.

23 Claims, 5 Drawing Sheets

METHOD AND APARATUS FOR SPRAY COATING

FIELD OF THE INVENTION

This invention relates to methods and apparatus for propelling molten particles onto a selected surface and, more particularly, to methods and apparatus for providing a coating of thermoplastic type material or the like on a selected surface.

BACKGROUND OF THE INVENTION

In the operation of existing devices of the character known as powdered flame spray guns, a very fine particulate thermoplastic material is heated to its melting point, such as by a propane flame. The resultant melted material is then propelled against the surface of article to be coated by means of a stream of propelling air, whereupon the molten material hardens to form the desired surface coating.

However, problems have been associated with such techniques in achieving the proper temperature and manner of mixture of the various spray ingredients, and in the manner of projecting the melted plastic against the article surface.

In a spray gun of the type disclosed in U.S. Pat. No. 4,632,309, an open-atmosphere powdered flame spray gun and a method of spray application are disclosed, in which a powderized thermoplastic material, combustion air, and a combustion gas are delivered through a plurality of passageways extending through the spray gun body into an open mixing and combustion chamber defined by a cylindrical hood about the spray gun body. The resultant mixture is ignited and the thermoplastic material is melted in the flame combustion area entrained in a stream of pressurized air which then deliverers the melted material to the desired surface to be coated. The disclosed method and apparatus were commercially successful, however, certain limitations and disadvantages were discovered to be inherent in the prior design and method.

One limitation discovered was that projecting the stream of combustible gas into the combustion chamber at an oblique angle toward the axis of the combustion chamber and toward the central stream of propelling air and entrained particulate material actually caused a "pinching" of the stream of particulate material and limited the quantity of thermoplastic material that could be melted and delivered for spray coating. In addition, the angular delivery of the combustible gas in the combustion chamber was found to limit the size of the flame "tunnel" emanating from the combustion chamber, and therefore was a self-limiting factor in the total quantity of particulate thermoplastic material that could be melted for spray application. Further, if increased flow rates of particulate material were desired to be delivered by the spray gun, an improved hopper and eductor feed means were necessary to entrain and mix the desired quantity of particulate material in the stream of propelling air.

Accordingly, an improved method and apparatus for spraying a greatly increased quantity of molten particles is disclosed in which the previously described problems associated with previous methods and apparatus are overcome by the present invention and a novel method and apparatus for applying powdered flame sprays is disclosed.

SUMMARY OF THE INVENTION

The present invention remedies the problems of the prior art by providing improved methods and apparatus for the application of a flame spray coating of molten particulate thermoplastic material onto a selected article surface.

In accordance with one principle of this invention, a flame spray gun for spraying molten particulate material is provided that comprises a body member, a flame hood assembly removably attached to the distal end of the body member, a flexible diaphragm disposed between the body member and the flame hood assembly and a material spray nozzle insertable through the body member and into the flame hood assembly. The body member, material spray nozzle and flame hood assembly have distal and proximal ends. The distal end of the body member has a planar surface transverse to the centerline of the body member, and a cylindrical bore disposed longitudinally therethrough and communicating with the distal and proximal ends. An annular recessed ring is disposed in the distal end planar surface in coaxial relationship to the cylindrical bore for defining a first annular chamber. A first passageway is disposed in the body member and communicates with the first annular chamber, while a second passageway is disposed in the body member and communicates with the cylindrical bore intermediate its length.

The material spray nozzle includes an elongated cylindrical member having an outer diameter less than the diameter of the body member cylindrical bore and disposed coaxially therein for at least a longitudinal portion thereof. The distal end of the cylindrical member projects longitudinally beyond the distal end of the body member for forming a nozzle end, and a longitudinal section of the cylindrical member including the distal nozzle end have an inner diameter increasing over the longitudinal length of the section towards the nozzle end for defining a nozzle tip that has an outwardly flaring cross-sectional inner surface configuration. The coaxial annular space between the outer wall surface of the cylindrical member and the body member cylindrical bore define a third passageway through the body member. A spacer is attached intermediate the length of the nozzle cylindrical member and projects radially for engaging the walls of the cylindrical bore to maintain the member in coaxial alignment within the cylindrical bore.

The flame hood assembly is constructed having a cylindrical hood section having an open end distal and a closed proximal end. The hood section includes a plurality of circumferentially-spaced apertures disposed radially therethrough and spaced intermediate the open and closed ends. A circular plate forming the closed end of the hood section is disposed internally of and transversely to the axis of the cylindrical hood section with the surface of the plate facing the hood section open distal end forming a distal planar surface cooperating with the inner surfaces of the hood section for forming a combustion chamber. The other side of the plate is sized to mate with the distal end face of the body member and forms a proximal planar surface. In addition, an annular recessed ring is disposed in the proximal planar surface of the plate in coaxial relationship with the axis of the hood section for defining a second annular chamber sized to register with the first annular chamber disposed in the distal end face of the body member.

The plate has a bore centrally disposed therethrough in coaxial alignment with the axis of the cylindrical hood section and is sized to register with the cylindrical bore disposed in the body member distal end and for receiving the projecting nozzle tip of the material spray nozzle. The bore diameter increases from the plate proximal planar surface to the distal planar surface to form a cross-sectional configuration of a truncated cone, the larger end of which faces the hood section open end. The plate further has a first plurality of spaced orifices disposed therethrough in a first circular pattern coaxial with the central bore and a second plurality of spaced orifices disposed therethrough in a second circular pattern coaxial with the central bore and radially spaced outwardly from the first circular pattern.

Both the first and second plurality of spaced orifices communicate with the second annular chamber, and the longitudinal axes of the first and second plurality of spaced orifices define a pair of concentric annular-shaped patterns coaxially disposed with respect to the hood section axis. An attachment section cooperates with the hood section and transverse plate for attaching the hood assembly to the body member distal end, with the second annular chamber and bore opening disposed in the plate proximal planar surface registering with the body member first annular chamber and bore opening, respectively.

Disposed between the plate proximal planar surface of the flame hood assembly and the distal end of the body member is a circular diaphragm constructed of a flexible and yieldable material for sealing engagement therebetween when the hood section and plate are attached to the body member distal end as above described. The diaphragm has an aperture disposed centrally therethrough, which has a diameter which registers with the diameter of the cylindrical bore disposed in the body member and the bore disposed in the plate second planar surface. The aperture permits the nozzle tip to project therethrough and continues the annular space between the nozzle outer wall and the inner surface of the central bores. The diaphragm further has a plurality of spaced apertures disposed therethrough in a circular pattern spaced radially from and coaxial with the central aperture for permitting communication between the body member first annular chamber and the plate second annular chamber.

In accordance with a further principle of this invention, a source of particulate material entrained in a stream of pressurized air is connected to the material spray nozzle cylindrical member for discharge through the nozzle tip in an expanding conically-shaped stream coincident with the axis of the cylindrical hood section. Further, a source of pressurized air is connected to the second passageway for flow through the third passageway and discharge through the bore opening in the plate first planar surface in an annular expanding conically-shaped stream concentrically surrounding the stream of particulate material. A source of a combustible gas is connected to the first passageway in the body member for supply to the first annular chamber and then through the plurality of diaphragm apertures into the plate second annular chamber for discharge through the first and second plurality of orifice openings disposed in the plate distal planar surface and forming a pair of concentric annular-shaped streams of combustible gas surrounding the concentrically disposed streams of compressed air and particulate material.

In the combustion chamber, the pair of concentric annular-shaped streams of combustible gas intersect with the annular expanding conically-shaped stream of pressurized air intermediate the plate and the open distal end of the hood section for supporting combustion of the gas when ignited. The flows of gas and burn air from a generally cylindrically-shaped flame tunnel coaxial with the axis of the hood section and having a diameter generally coincident with the diameter of the hood section for accommodating and melting the radially expanding stream of particulate material that passes coaxially therethrough.

In accordance with another principle of the invention, the flame spray coating system further includes a hopper for containing a quantity of the thermoplastic particulate material, a source of regulated pressurized air, and an eductor mechanism cooperating with the hopper and the source of air for entraining and mixing preselected quantities of the particulate material from the hopper in a stream of the air for defining the source of the particulate material applied to the material spray nozzle cylindrical member. A shut-off valve is interposed between the eductor mechanism and the flame spray gun material spray nozzle member and is operable to control the application of the particulate material and air mixture to the spray gun. In addition, a pilot valve is connected between the source of regulated pressurized air and the eductor means for permitting free flow of the air through the eductor when the shut-off valve is open and prohibiting flow of the air into the eductor when the shut-off valve is closed in order to prohibit blowback of the pressurized air into the hopper when the shut-off valve is closed.

In accordance with still another principle of this invention, the eductor mechanism has a body member that includes an inverted conically-shaped receiver for receiving the particulate material from the hopper, and a vertically-oriented cylindrical chamber disposed in the body member and having an upper open end and a lower closed end. The chamber upper open end is in communication with the inverted apex of the receiver. The body member has a cylindrical bore horizontally disposed therethrough and intersects the chamber, with one portion of the bore communicating between the pilot valve and the chamber for defining a first passageway in the body member, and the portion of the bore communicating between the chamber and the shut-off valve defining a second passageway in the body member. A nozzle is disposed in the first passageway in the body member and cooperates with the chamber for educting the particulate material from the receiver chamber into the body member second passageway for entraining the particulate material in the stream of air flowing therethrough.

In accordance with another principle of this invention, the nozzle includes an externally threaded elongated cylindrical member adapted for adjustable insertion into the body member first passageway, and having a tapered nozzle end insertable transversely through the chamber and partially into the second passageway. The nozzle directs the stream of pressurized air from the pilot valve into the second passageway and lowers the air pressure in the chamber for educting the particulate material from the receiver chamber into the second passageway entrained in the stream of pressurized air.

In still another principle of this invention, the shut-off valve includes a two-position, three-way valve having the pilot valve alternate outlet interconnected thereto.

The valve is operable to a first position for permitting the particulate material entrained in the pressurized air to be applied to the flame spray gun and closing the pilot valve alternate outlet. The valve is operable to a second position for prohibiting the flow of particulate material entrained in the stream of pressurized air, but permits the air from the pilot valve alternate outlet to by-pass the eductor mechanism and be exhausted to the flame spray gun instead of back into the eductor mechanism and the hopper carrying the particulate material.

BRIEF DESCRIPTION OF THE DRAWINGS

In order that the manner in which the above-recited advantages and features of the invention are attained can be understood in detail, a more particular description of the invention may be had by reference to specific embodiments thereof which are illustrated in the accompanying drawings, which drawings form a part of this specification.

In the drawings.

DETAILED DESCRIPTION OF THE PREFERRED EMBODIMENTS

Figure 1:
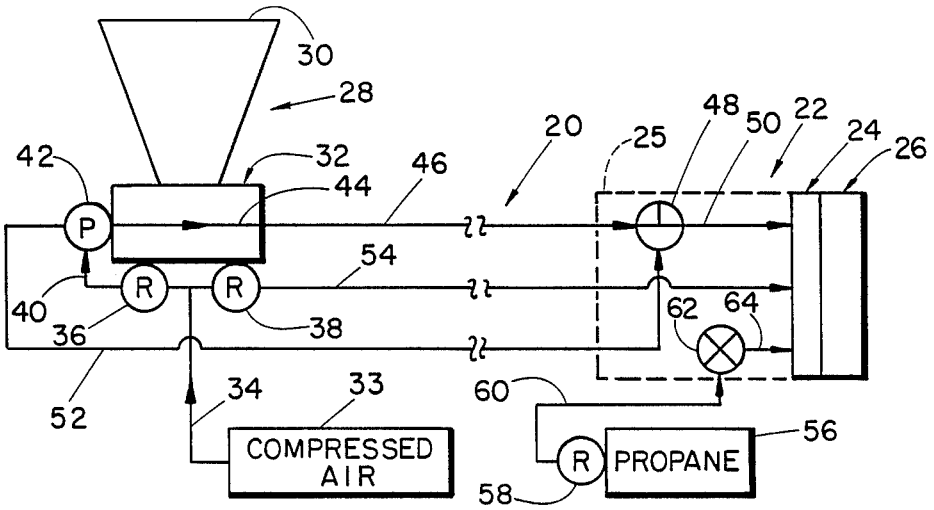
FIG. 1 is a general schematic view of the overall spray coating system according to this invention.

FIG. 1 depicts a schematic view of the flame spray gun system 20 showing the flame spray gun generally in a block diagram form at 22. The gun has a body 24, a flame hood assembly 26 attached thereto and a sleeve/-handle 25 shown in dotted lines and that structurally surrounds the incoming burn air, particulate material and combustible gas lines as will hereinafter be shown in greater detail in FIG. 2. A hopper assembly 28, comprises a gravity-fed hopper 30 and a base 32 carrying an eductor mechanism. The hopper 30 holds a selected quantity of particulate thermoplastic material or the like and disperses the material by gravity feed in to the base 32 and the educator mechanism as will hereinafter explained in greater detail. A source of pressurized air 33 applies the air through a supply line 34 to a pair of conventional air pressure regulators 36 and 38. Regulators 36 and 38 may conveniently be mounted on the hopper assembly body 32 as shown, or may be attached to or placed on the pressurized air source, such as a steel tank or compressor. Pressurized regulated air from regulator 38 is applied directly to the gun 22 via a line or hose 54 in a manner that will be hereinafter described in greater detail.

The pressurized regulated air from regulator 36 is applied through line 40 to a conventional pilot valve 42, which is conveniently mounted on the hopper body 32. Regulated pressurized air passes through the pilot valve 42 and through a bore disposed in the body member 32, shown generally by the line and arrow 44 therethrough, for entraining and mixing the particulate material in the pressurized air stream by eductor action from hopper 30. The particulate material/pressurized air mixture is applied through a line or hose 46 to a two-position three-way valve 48, and then as an output to the gun 22 via line 50 as will be hereinafter described in greater detail. The alternate outlet of the pilot valve 42 is connected by a line or hose 52 as another input to the valve 48 for purposes to be hereinafter further explained.

A source of combustible gas 56, such as propane gas commonly packaged in a portable tank or canister, is applied through a conventional gas regulator 58 and a supply line or hose 60 to a conventional shut-off valve 62 and then through a line 64 to the gun 22 as will be hereinafter described in more detail. When the gas valve 62 is opened, propane gas is supplied to the gun, and when the valve 48 is manipulated to permit the particulate thermoplastic material/pressurized air mixture from the hopper assembly 28 to be applied to the gun 22 through a supply hose 46, and burn air is supplied to the gun 22 through the supply line or hose 54, the mixture may be ignited within the flame hood assembly as will be hereinafter described in detail.

The construction and operation of the flame spray gun 22 will now be described in detail with reference to FIGS. 1–7. The gun 22 basically comprises a cylindrical body member 24, a flame hood assembly 26, a material spray nozzle 80 and a flexible diaphragm 92. The body member 24, the material spray nozzle 80 and the flame hood assembly 26 will be described as having a "proximal" end defining the end nearest the air and gas connections, and a "distal" end defining the end most distant from the air and gas connections (see FIGS. 1, 2 and 3). Accordingly, as more clearly seen in FIG. 3, the body member 22 has a proximal end 120 and a distal end 122, while the flame hood assembly has a proximal end 128 and a distal end 129. The material spray nozzle has a proximal end 85 and a distal end 91.

Figure 6:
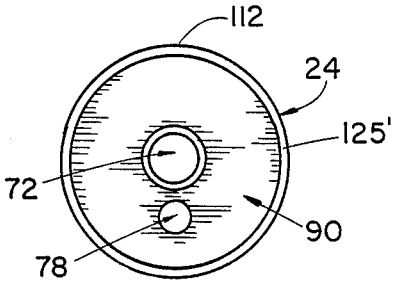
FIG. 6 is a elevation view of the distal end of the body member.
Figure 7:
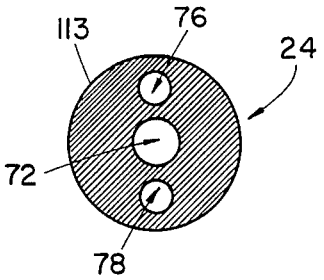
FIG. 7 is a vertical cross-sectional view of the body member taken along lines 7—7 of FIG. 3.
Figure 8:
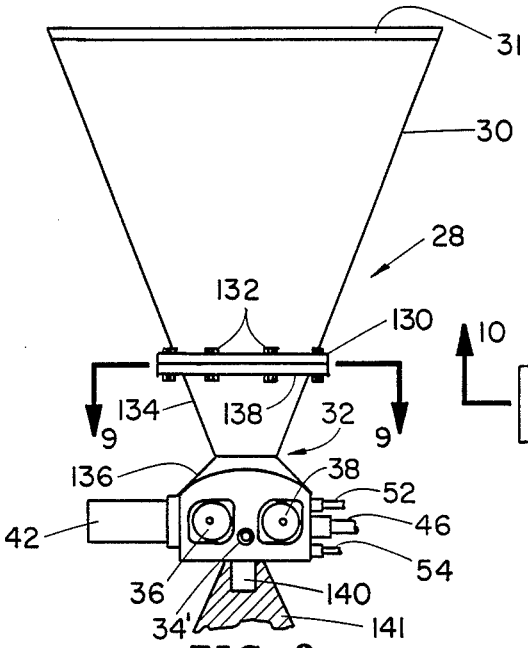
FIG. 8 is a detailed side elevation view of the hopper and eductor means shown schematically in FIG. 1.
Figure 9:
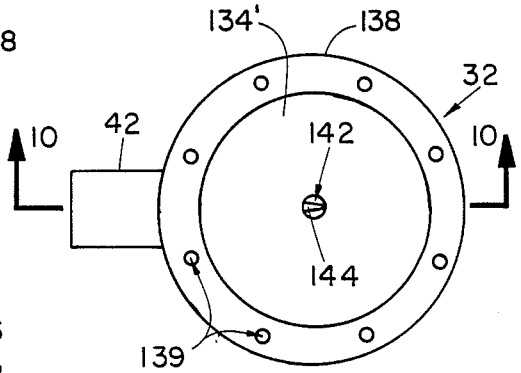
FIG. 9 is a horizontal cross-sectional view of the eductor means taken along lines 9—9 of FIG. 8.
Figure 11:
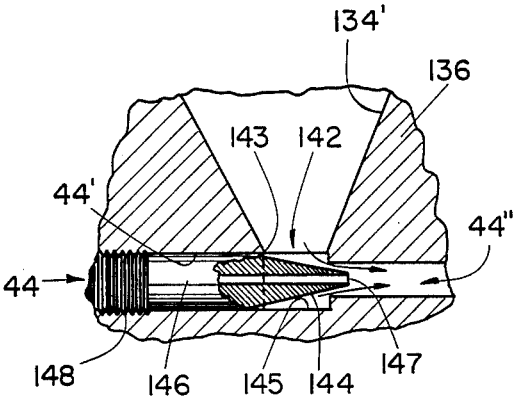
FIG. 11 is an enlarged fragmentary view of a portion of the eductor means shown in FIG. 10.
Figure 10:
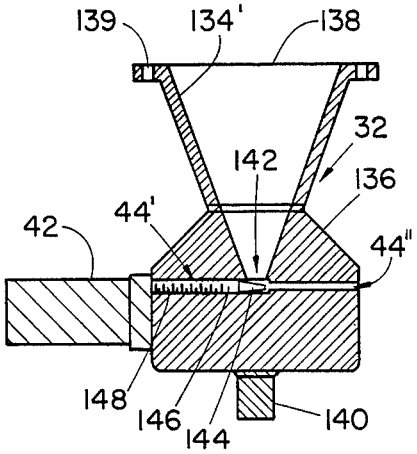
FIG. 10 is a vertical cross-sectional view of the eductor means taken along lines 10—10 of FIG. 9.

The body member 24 includes an elongated cylindrical section 113 integrally joined to a cylindrical section 112 of larger diameter at shoulder 110. The outer surface of section 112 is threaded at 109 for mating with the flame hood assembly as will be hereinafter described. The body member distal end 122 has a planar surface 125 transverse to the centerline of the body member, while the proximal end 120 has a planar surface 70 transverse to the body member centerline. A cylindrical bore 72 is disposed longitudinally through the body member 24 along its central axis and communicates with both the distal and proximal planar end faces 125 and 70, respectively. An annular recessed ring 90 is disposed in the body member distal end surface 125 in coaxial relationship to the cylindrical bore 72 for defining a first annular chamber. As may best be seen in FIGS. 3 and 6 (where FIG. 6 is an end view of the distal end planar surface 125 of body member 24), the planar surface 125 includes an outer annular ring surface 125' and an inner annular ring surface 125" coaxially disposed with respect to bore 72 and radially separated by the coaxial first annular chamber 90.

A first aperture or passageway 78 is disposed through the body member 24 communicating with the body member proximal end face 70 and the first annular chamber 90. A second aperture or passageway 76 is disposed in said body member 24 and communicates with the proximal end surface 70 and the cylindrical bore 72 intermediate its length. The bore 72 also has a threaded portion 86 adjacent the body member proximal end 120 for mating with the material spray nozzle 80 as will be further described below.

The material spray nozzle comprises an elongated cylindrical member 80 having an outer diameter less than the diameter of the cylindrical bore 72 and coaxially disposed in the bore. The nozzle 80 has an enlarged externally threaded section 86' that removably mates with the threaded portion 86 of the bore 72 to secure the nozzle 80 therein. The nozzle 80 also has a second enlarged section 84 adjacent the proximal end 85 and intermediate end 85 and the enlarged externally threaded section 86'. The enlarged end section 84 has an annular shoulder 87 facing the threaded section 86' for engaging the proximal end face 70 of the body member when the nozzle tube 80 is threaded into the bore 72.

A radially extending spacer 82 is mounted on the outer wall surface of the tube 80 intermediate the distal end 91 thereof and the threaded section 86'. The spacer 82 engages the walls of the bore 72 for maintaining the nozzle member 80 in coaxial alignment within the cylindrical bore. The cylindrical member 80 has a nozzle section 81 adjacent the proximal end 91 that includes an inner diameter increasing over the longitudinal length of the section towards the end 91. In cross-section (see FIGS. 2 and 3) the inner surface 106 of the nozzle section 81 defines a nozzle tip having an outwardly flaring (truncated conical shape) cross-sectional configuration over the length of the nozzle section 81. The annular space 74 between the outer surface of the nozzle cylindrical member 80 and the coaxial bore 72 defines a third passageway disposed in the body member 24 for purposes to be hereinafter explained in greater detail.

The flame hood assembly 26 (see FIGS. 2–7) is a generally cylindrical member having a proximal end 128 and a distal end 129. The flame hood assembly 26 comprises a cylindrical hood section 96 including the open end 129 and a closed end 115. The hood section 96 has thin cylindrical walls 97 and includes a plurality of circumferentially-spaced apertures 118 disposed radially about the circumference of the cylindrical hood section and spaced adjacent the closed end 115. The closed end 115 comprises a circular plate that is disposed internally of and transversely to the axis of the cylindrical hood section 96. The surface of the plate 115 facing the hood section open distal end 129 forms a distal planar surface 100 cooperating with the inner surfaces of the cylindrical hood walls 97 for forming a combustion chamber 99, the function of which will be hereinafter explained in greater detail. The other side of the plate 115 is sized to engagingly mate with the body member distal end face 122 and forms a proximal planar surface 127. The plate proximal planar surface 127 includes an annular recessed ring 114 disposed therein in coaxial alignment with the axis of the hood section for defining a second annular chamber. Chamber 114 is sized to register with the first annular chamber 90 disposed in the distal end face of 125 of body member 24.

The plate 115 carries a bore 106 centrally disposed therethrough and in coaxial alignment with the axis of the flame spray hood assembly 26 and is sized to register with the cylindrical bore 72 disposed in the body member distal end 122. The bore 106 in plate 115 receives the projecting nozzle tip end 91 of the material spray nozzle 80, with the bore 106 increasing in diameter from the proximal planar surface side 127 to the distal planar surface side 100 to form a cross-sectional configuration of a truncated cone, the larger end of which faces toward the hood section open distal end 129.

The plate 115 has a first circular pattern of circumferentially spaced orifices 104 disposed through the plate coaxial with the central bore 106 and communicating between the distal end face 100 of the plate and the interior of the second annular chamber 114. The plate 115 further has a second circular pattern of circumferentially spaced orifices 102 disposed therethrough coaxial with the central bore 106 and concentric with the first circular pattern of orifices 104. The second circular pattern of spaced orifices 102 are spaced radially outwardly from the first circular pattern 104, and communicate with the distal end surface 100 and with the interior of the second annular chamber 114. The longitudinal axes of the first and second plurality of circumferentially spaced orifices 102 and 104 define a pair of concentric annular-shaped patterns coaxially disposed with respect to the hood section axis for purposes that will be hereinafter described in greater detail.

The proximal end 128 of the flame hood assembly 26 includes a generally cylindrical attachment section 108 that has an inner diameter coincident with the outer diameter of the body member section 112 and as disposed therein an inner threaded surface 116 for threadably mating with the body member threaded surface 109. The proximal end face 127 of plate 115 defines an outer annular ring surface 127' and an inner annular ring surface 127" coaxially disposed with respect to the central bore 106, and are radially separated by the coaxial second annular chamber 114. The diameters of the outer and inner ring surfaces 127' and 127" are identical to the diameters of the outer and inner ring surfaces 125' and 125" of the body section 24 and are sized to register therewith.

A thin circular diaphragm 92 (see FIGS. 2, 3 and 5) is constructed of a flexible and yieldable material and is disposed between the body member distal end planar surface 125 and the hood member plate proximal planar surface 127. The diaphragm 92 carries a central aperture 95 therethrough, the diameter of which is identical with and registers with the diameters of the cylindrical bore 72 disposed in the body member 24, and the bore 106 opening disposed in the plate 115 proximal planar surface 127 for permitting the spray nozzle tip 91 to project therethrough as hereinabove described. The diaphragm also carries a plurality of circularly-spaced apertures 94 disposed therein in a pattern coaxial with the central aperture 95 and spaced radially from the aperture 95 to communicate with the body member first annular chamber 90 and the hood member plate second annular chamber 114.

Figure 2:
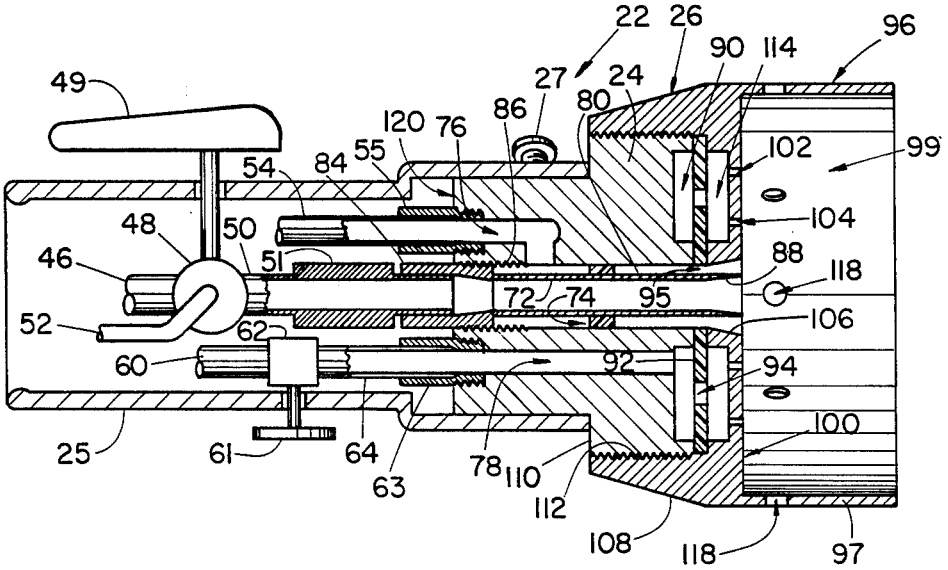
FIG. 2 is a vertical cross-sectional view of the flame spray gun identified in the schematic view of FIG. 1.
Figure 3:
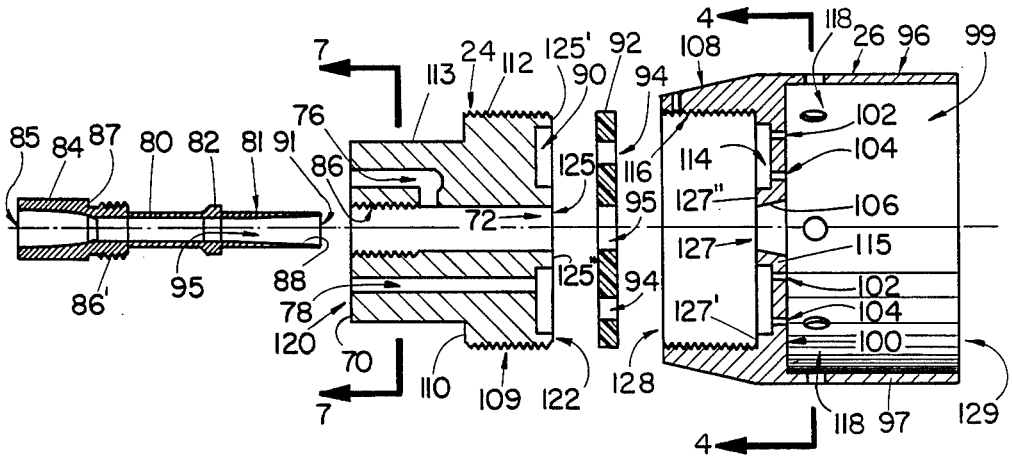
FIG. 3 is an exploded vertical cross-sectional view of the spray gun body member, the material spray nozzle, the flame hood assembly and the diaphragm shown in FIG. 2.
Figure 4:
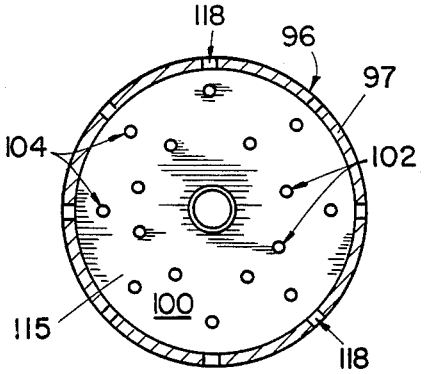
FIG. 4 is a vertical cross-sectional view of the flame hood assembly taken along lines 4—4 of FIG. 3.
Figure 5:
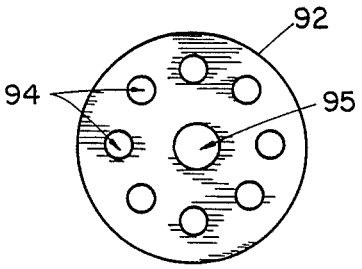
FIG. 5 is a distal end elevation view of the diaphragm shown in FIG. 3.

As may be seen in FIGS. 2 and 3, the diaphragm 92 is disposed between the body member distal end planar surface 125 and the plate proximal planar surface 127, and sealingly engages the planar surfaces 125 and 127 between the registering projecting annular planar ring surfaces 125' and 125", and 127' and 127", respectively. With the diaphragm 92 acting as a seal between the body member 24 and the flame hood assembly 26, the first annular chamber 90 and the second annular chamber 114 are sealed together, and separated only by the flexible diaphragm 92 which has communicating apertures 94 therethrough for permitting combustible gas flow therethrough as will be hereinafter further described.

Referring now to FIGS. 1, 2 and 3, a conventional supply line or hose connector 55 is shown attached to the proximal end 120 of the body member 24 in coaxial communication with the passageway 76 and is attached to the supply line or hose 54 for supplying pressurized burn/propelling air to the gun 22. Similarly, a conventional line or hose connector 63 is coaxially attached to the proximal end 120 of body member 24 to communicate with the passageway 78. The connector 63 communicates through a rigid pipe or tubing portion 64 to a shut-off valve 62, manually operable by a projecting valve handle portion 61, and to which a flexible line or hose 60 is attached and supplies a source of regulated combustible gas (see FIG. 1).

A conventional line or hose connector 51 is attached to the proximal end 85 of the material spray nozzle 80 for communicating with the bore 95 therethrough. The connector 51 has projecting coaxially therefrom a rigid tube member 50 that is connected to the two-way three-position valve 48 that was previously described with respect to FIG. 1. The valve 48 is manually operable by projecting handle 49, with the valve receiving the particulate material entrained in the stream of pressurized propelling air through a flexible line or hose 46. The valve 48 also has a second connection through a line 52 from the alternate output of the pilot valve 42 (see FIG. 1).

A cylindrical sleeve/handle member 25 is shown surrounding the input lines 54, 46, 52 and 60 and the valves 48 and 62, with one end thereof radially mating with the smaller cylindrical portion 113 of body member 24. The sleeve/handle member 125 may be attached to the body member 24 by means of screws 27, or any other suitable conventional fastening mean. The valve operating handles 61 and 49, associated with valves 62 and 48, respectively, project through openings in the sleeve/handle member 25 for making the valve handles readily accessible for operating the valves. The sleeve/handle member 25 also functions to provide a grasping or handle surface for manually manipulating and handling the flame spray gun 22, as well as protecting the valves and hose connections from the various gas, air and particulate material supply lines.

Referring now to FIGS. 8-11, the construction, function and operation of the hopper assembly 28 will be described in detail. The hopper assembly includes a conically-tapering hopper 30 having a closure lid 31 vertically mounted on an eductor mechanism or means 32. The lower end of the hopper has a flange 130 for mating with a upper flange 138 of the eductor mechanism 32 and secured together by means of conventional fasteners, such as bolts 132. The eductor mechanism 32 includes a body member 136 and a vertically oriented inverted conically-shaped receiver section 134 terminating in the upwardly facing flange 138. The downwardly and inwardly slanting walls 134' of the conically-tapering receiver section 134 terminates in a vertically-oriented cylindrical chamber 142 within the body member 136. The chamber 142 has a lower closed end 145 and an upper open end 143 communicating with the receiver section 134. The body member 136 has disposed therethrough a horizontally-oriented cylindrical bore 44 that centrally intersects the chamber 142. The body member 136 are shown mounting externally thereof the pair of conventional air regulators 36 and 38 shown in FIG. 1. Pressurized air from a source 33 is applied through a fitting 34' to an internal bore (not shown for simplicity) for applying the pressurized air to the pair of regulators 36 and 38 for the purposes hereinabove discussed with respect to FIG. 1. A conventional pilot valve 42 is also shown externally mounted on the eductor body member 136 in communication with one end of bore 44. Regulated pressurized air from regulator 36 is applied via an internal bore or passageway (not shown) as an input to the pilot valve. The base of the body member 136 may have a downwardly projecting stud 140 for mounting in a matching bore of a stand or other supporting means shown generally at 141. The stud 140 permits the hopper assembly 28 to be attached to such a described stand or base 141 or to be removed for portable use, such as by means of straps (or a backpack unit or the like [not shown]). Connections for the supply lines or hoses 46, 52 and 54 to the flame spray gun 22 (see FIGS. 1 and 2) are shown mounted on one side of the body member 136.

The internal horizontal bore 44 communicates between the pilot valve 42 and the connection to supply line 46. The portion of the horizontal bore 44 communicating between the pilot valve 42 and the chamber 142 defines a first passageway 44' in the eductor body member 136, while the portion of the bore 44 communicating between the chamber 142 and the supply line 46 defines a second passageway 44" in the body member 136.

A nozzle having an elongated cylindrical body portion 146 and a conically-tapering nozzle tip 144 is removably insertable in the first passageway 44'. The outer wall surface of at least a portion of the nozzle body 146 carry threads 148 that mate with a threaded portion (not shown for simplicity) of the first passageway 44'. The threaded connection between the nozzle body 146 and the walls of the first bore passageway 44' permit the nozzle tip 144 to be horizontally adjustable with respect to the chamber 142 and the second passageway 44". The nozzle body 146 is horizontally adjusted within the bore 44' to position the conically-tapering nozzle end 144 within the chamber 142 to permit the nozzle tip 147 to project into the bore 44" but leaving sufficient annular clearance between the tapering end 144 of the nozzle and the bore 44" (as shown by the arrows) for permitting free flow of particulate thermoplastic material from the hopper 30, receiver 134 and chamber 142 into the second passageway 44".

In operation, the pressurized air stream carried by nozzle 146 is injected into the second passageway 44' by the nozzle end 144. The high-velocity air stream passing into the second passageway 44" causes a lowering of the air pressure (due to venturi action) in the annular area surrounding the nozzle end 144 which is communicated to the interior of the chamber 142 and the receiver 134. This lowering of the air pressure in the chamber 142 causes high-velocity air flow from the chamber 142 and receiver 134 into the second passageway 44" that is shown by the arrows in FIG. 11. The particulate material from the chamber 142 is carried into the second passageway by eductor action and is entrained in the stream of pressurized air passing through the bore portion 44" into the gun supply hose 46.

As described above, the adjustment of the spacing between the nozzle end 144 with relation to the junction of the chamber 142 and the bore section 44" regulates the negative pressure (developed by venturi action) in the chamber 142 and determines the flow rate of the particulate material from the hopper assembly 28 into the gun supply line 46. In practice, the nozzle end 144 is adjusted to obtain the highest negative pressure within the chamber 142 and thus the maximum flow rate of particulate material therefrom. While prior eductor mechanisms have been used to educt particulate material from a hopper into a supply line, the above described construction featuring the nozzle end 144 adjustable with respect to the chamber 142 and outlet bore section 44" permits a substantive increase, in the flow rate of the particulate material entrained in the pressurized stream of supply air. The increased flow rate accomplishes a 400% to 700% increase in the quantity of particulate material that can be entrained in the pressurized stream of supply air without a corresponding increase in the flow rate of the pressurized air passing through bore 44.

In prior art eductor systems, such as the system disclosed in U.S. Pat. No. 4,632,309, the maximum flow rate of the pressurized supply air into the gun supply line was 4.0 cfm and the maximum flow rate of the particulate material educted into the stream of pressurized air was 0.75 pounds/min. However, utilizing the above-described adjustable nozzle arrangement, with a maximum supply air flow rate of 4.0 cfm, a maximum flow rate of particulate material of 3.0 pounds/min. can be achieved, thus greatly increasing the quantity of thermoplastic material that can be supplied to the flame spray gun 22.

Typical thermoplastic particulate materials used in the flame spray process may include NUCREL, SURLYN, ELVAX products commercially available from the DuPont Corporation. However, it is to be specifically noted that the methods and apparatus of the present invention admit to the use of a number of feedstock materials that can be placed into the hopper assembly 28, and accordingly, the invention is not intended to be so limited to the products herein listed. Substantially any powderized plastic feedstock having a thermoplastic property, such as polyethylene, may be employed with good effect without departing from the spirit and scope of the invention.

The feedstock material will preferably have a particle mesh size between 50–100 mesh. Some typical commercial material feedstocks will have already added thereto a number of additives which will render the feedstock more suitable to the application herein described, such as the aforementioned NUCREL and SURLYN materials. However, with respect to other feedstocks, it has sometimes been found desirable to include additives counteracting the adverse effect of light on the plastic such as a UV Stabilizer 531, or an additive such as Ergonox 1010 for improving the properties of the feedstock in the presence of heat, both such additives being commercially available from the CIBAGEIGY Company. Additionally, in some applications it has further been found desirable to add talc or a like material to the feedstock material as a "slip" additive to enhance the lubricous or flowing characteristics of the particulate material or even to add some form of elastomer to improve the flexing characteristics of the spray coat applied to the article.

From a review of FIGS. 1 and 2, it will be appreciated that three separate and distinct passageways for fluid or particulate material have been provided for use with the gun 22. First, particulate material entrained in supply air passing through hose 46 will, in turn, pass through connector 51, nozzle bore 95 and be injected into chamber 99 of hood 26. In like manner, pressurized air provided through hose 54 will be passed through connector 55, the second passageway 76 into the cylindrical bore 72, the annular space 74 surrounding the nozzle member 80, and finally into chamber 99. Propane or another appropriate source of combustible gas will, similarly, pass through hose 60, valve 62, connector 63, first passageway 78 into the first annular chamber 90, through diaphragm apertures 94 into the second annular chamber 114, and finally through the sets of orifices 102 and 104 into chamber 99. For reasons which will become apparent hereinafter, the pressurized air flowing through hose 46 will be referred to as conveying air, and the pressurized air flowing through hose 54 will sometimes be referred to as propelling air.

It should be noted that the arrangement of the cylindrical bore 72, the spray nozzle bore 95, the first and second sets of orifices 102 and 104 and the apertures 118 in the hood section walls 97 will set up flows which are important to the improved operation of the apparatus. In order to more particularly appreciate such improved operation, the operation of spray gun 22 will be hereinafter described in comparison to the operation of the prior art gun disclosed in U.S. Pat. No. 4,632,309, shown in FIGS. 12, 13 and 16, while the operation of the present invention will be described in relation to FIGS. 14, 15 and 17. The generally corresponding elements of the prior art spray gun in FIGS. 12, 13 and 16 will be identified with identical reference numbers carrying a superscript "'" to the reference numbers identifying the elements of the invention disclosed herein.

Figure 13:
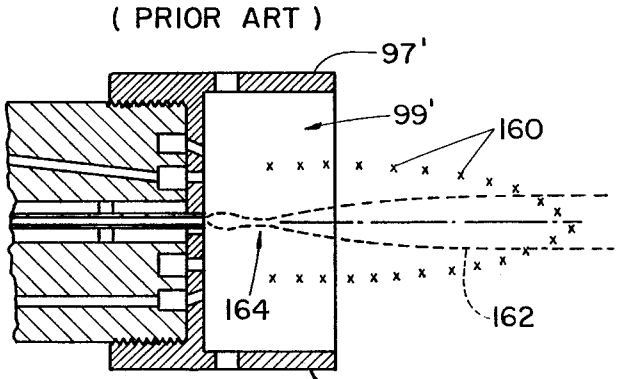
FIG. 13 is a partial vertical cross-sectional view of the flame "tunnel" and stream of particulate material propelled therethrough for the spray gun disclosed in FIG. 12.
Figure 12:
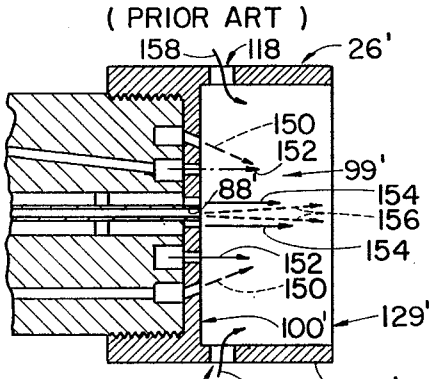
FIG. 12 is a partial vertical cross-sectional view of a spray gun disclosed in the prior art showing the paths of the burn air, combustible gas and particulate material as discharged into the combustion chamber.

Referring now to FIGS. 12 and 13 (prior art) when viewing the hood assembly 26' from the distal end 129' along its central longitudinal axis, a circular flow of particulate material feedstock 156 has been established. The material entrained in conveying air is discharged out of the cylindrical nozzle bore 88'. Since the nozzle bore tip is straight, the propelling air stream 156 carrying the thermoplastic particulate material will be generally cylindrical in shape, although due to the expansion of the conveying air as it leaves the nozzle tip 88', there will be some radial expansion of the conveying air stream. Radially outward of and about the central flow of particulate material 156, an annular propelling air flow 154 in the form of an annular ring is established as it exits the annular space between the outer surface of the nozzle tip and the bore centrally disposed thorough the plate surface 100'. A first annular air stream 152 is discharged through orifices 102' to form a concentric radially-spaced annular-shaped stream of air coaxially encircling the annular flow of propelling air 154 and the circular stream of particulate material and conveying air flow 156. An annular gas stream 150 is discharged from the orifices 104 at an oblique angle to the axis through the hood assembly 26', in a downwardly and inwardly direction as shown, to form a conically inwardly directed annular flow of gas that is coaxially and radially spaced and encircles the above described air and particulate material streams.

The inter-section of the gas stream 150 and the air stream 152 occurs within the combustion chamber 99' intermediate the distal face 100' of the plate, and the distal end of the hood 129' and mix in a generally concentric annular stream surrounding the central annular air stream 154 and the cylindrical stream of particulate material 156. In addition, air from outside of the hood will be drawn into the combustion chamber 99' through the radial apertures 118' to form an annular flow of air 158 generally concentric with and surrounding the annular gas flow 150 and air flow stream 152. This air flow 158 also mixes with the gas and air streams 150 and 152 within the combustion chamber 99'. The mixing of the gas and air flows above discussed is sufficient, when ignited, to support combustion within the chamber 99', and will create a flame "tunnel" 160 (see FIG. 13). The flame "tunnel" 160 has a cross-sectional configuration shown diagrammatically in FIG. 13 that coaxially surrounds the stream of particulate material entrained in the mixed flows of conveying and propelling pressurized air having a cross-sectional configuration shown diagrammatically at 162 in FIG. 13.

In the prior art gun shown in FIGS. 12 and 13, it was discovered that while the angled stream of gas 150 functioned to force the gas stream 150 and burn air stream 152 to intersect for prope mixing prior to ignition to form the flame "tunnel" 160, the inward force of the angled gas stream 150 also tended to "pinch" the stream of particulate material in the area of 164 (FIG. 13). This severe "pinching" action reduced the diameter and thus the cross-sectional area of the particle stream 162 and limited the quantity of thermoplastic material that could be sprayed by the gun.

Figure 16:
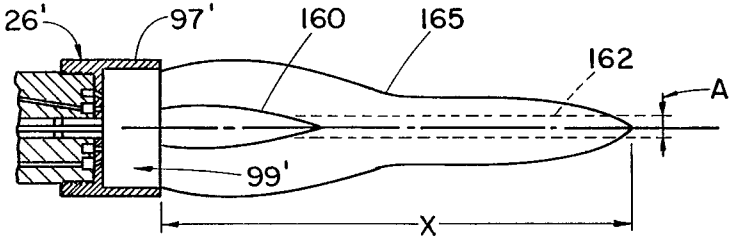
FIG. 16 ( PRIOR ART )
FIG. 16 is partial vertical cross-sectional view of a prior art spray gun showing the flame configuration emanating from the flame hood assembly.

Referring now to FIG. 16, a cross-sectional diagram of the prior art spray gun flame 165 is shown. The outer border of the flame envelope 165 is shown coaxially surrounding the hotter flame "tunnel" 160. The stream of molten particulate thermoplastic material 162 is shown propelled beyond the flame tunnel 160 within the flame boundary 165. However, because of the limitations in the design of the prior art spray gun and the dynamics of the air, gas and particulate matter streams above described, coupled with limitations in the particulate matter eductor system (not shown) the flame spray stream 162 was limited in the cross-sectional area that it could cover, as well as the cross-sectional density of the melted material within the stream. In practice, the maximum length "X" (FIG. 16) of the flame envelope 165 was on the order of 12–14 inches, and the maximum diameter "A" (FIG. 16) of the molten particle material stream was about 1 to 1.5 inches. This meant that the operator had to work close to the surface being coated and multiple passes of the spray gun were necessary to cover a given square footage of article surface. However, these limitations have been overcome in the disclosed invention, and the significant structural and operational differences will be discussed in detail.

Figure 15:
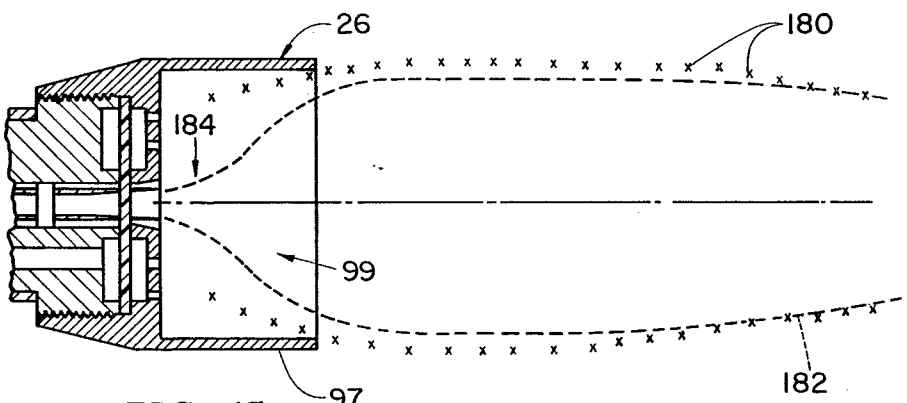
FIG. 15 is a partial vertical cross-sectional view of the flame "tunnel" and stream of particulate material propelled therethrough for the spray gun disclosed in FIG. 14.
Figure 14:
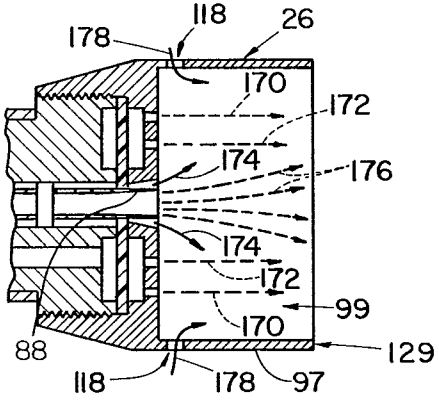
FIG. 14 is a partial vertical cross-sectional view of the spray gun disclosed herein showing the paths of the burn air, combustible gas and particulate material discharged into the combustion chamber.
Figure 17:
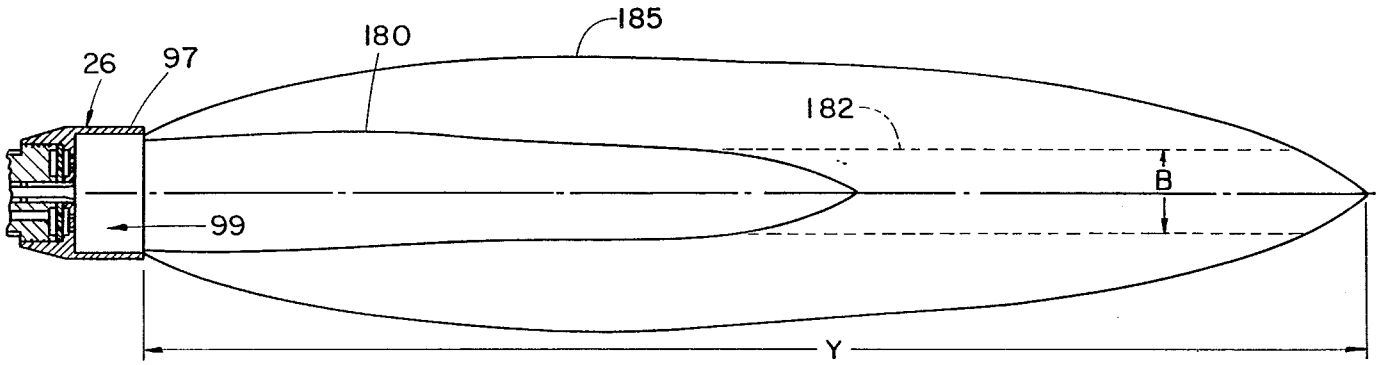
FIG. 17 is a partial vertical cross-sectional view of the spray gun disclosed herein showing the flame configuration emanating from the flame hood assembly.

Now referring to FIGS. 14, 15 and 17, when viewing the hood assembly 26 from the distal end 129 along its central longitudinal axis, a circular radially expanding flow of feedstock 176 has been established. The material entrained in conveying air is discharged out of the cylindrical flared nozzle bore 88. Radially outward of and about this radially expanding central flow 176, an annular burn/propelling air flow 174 in the form of a radially expanding annular ring has been established that exits the annular space between the outer surface of the nozzle tip 91 and the surface of the bore 106 centrally disposed through plate 115 (see FIGS. 2 and 3). First and second annular gas streams 170 and 172 are discharged through orifices 102 and 104, respectively, to form a pair of concentric radially-spaced annular-shaped streams of gas coaxially encircling the annular flow of burn/propelling air 174 and the circular stream of conveying air and particulate material 176. Since the axis of the rings of orifices 102 and 104 are coaxial with the longitudinal axis of the gun 22 and the combustion chamber 99, the pair of concentric annular streams of gas 170 and 172 will intersect the conically-shaped expanding stream of burn/propelling air 174 that is generally concentric with the conically-shaped expending stream of conveying air and particulate material 176 expelled from the nozzle bore 88.

The intersection of the annular gas streams 170 and 172, the annular outwardly expanding air stream 174 and the circular outwardly expanding flow or stream of conveying air and particulate material 176 will occur in the combustion chamber 99 intermediate the plate distal surface 100 and the open distal end 129 of the hood section. In addition, air from outside of the hood will be drawn into the combustion chamber 99 through the radial apertures 118 to form an annular flow of air 178 generally concentric with and surrounding the pair of annular gas flows 170 and 172. This air flow 178 also mixes with the concentric annular streams of gas 170 and 172 within the combustion chamber 99. The mixing of the gas and air flows above discussed is sufficient to support combustion, when ignited, within the chamber 99, and will create a flame "tunnel" 180 having a cross-sectional configuration diagrammatically shown in FIG. 15. The flame "tunnel" 160 coaxially surrounds the stream 176 of particulate material entrained in a mixture of conveying and propelling air having a cross-sectional configuration diagrammatically indicated at 182 in FIG. 15.

As may be seen from FIGS. 14 and 15, the streams of propelling air 174 and conveying air/particulate material 176 are radially expanding flows resulting from the flared or conically-shaped outwardly expanding shape of the plate bore 106 and the nozzle bore 88. This radial expansion along the longitudinal axis of the chamber 99 causes the particulate material and conveying air stream 176, and the annular propelling air stream 174 to rapidly expand outwardly at 184 (FIG. 15) to intersect and to force radially outwardly the concentric annular gas streams 172 and 170. This radial expansion and intersection of the air and gas streams forces the ignited flame "tunnel" outwardly to a diameter substantially coincident with the diameter of the hood walls 97. This action expands the cross-sectional area of the flame "tunnel"

180 on the order of 5–10 times that achieved in any prior art gun, such as that represented in FIG. 16. Such a magnitude of expansion of the cross-sectional area of the flame "tunnel" 180 also accommodates a greatly increased cross-sectional area of the particulate material stream 182 for greatly increasing the volume of material that can be melted and applied to the desired article surface.

In FIG. 17, a cross-sectional diagram of the improved spray gun flame is shown. The outer border of the flame envelope 185 is shown coaxially surrounding the hotter flame "tunnel" 180. The stream of molten particulate thermoplastic material 182 is shown propelled beyond the flame tunnel 180 within the flame boundaries 185. It should be appreciated that since the temperature of the hotter flame "tunnel" 180 cannot be varied appreciably, the transit time of the stream of particulate material 182 longitudinally through the flame "tunnel" is of critical importance to achieving proper melting of the thermoplastic material. If the transit time is too short, all of the thermoplastic material will not be properly melted and the resulting spray coated surface will be a defective combination of melted and unmelted particles. On the other hand, if the transit time of the thermoplastic material is too long, the material particles will be over heated and burned, also resulting in a defective spray coating. The transit time of the stream of particulate material 182 through the flame "tunnel" 180 may be controlled by varying the flow rate of the air propelling the particulate material into the spray gun nozzle 80 by an appropriate adjustment of the regulator 36 as will hereinafter further be described.

The overall length "Y" of the flame 185 (see FIG. 17) is on the order of 36 inches and the diameter of the stream of particulate material shown at "B" is on the order of 3.5 to 4.5 inches, which translates to an increased cross-sectional area of 5 to 10 times the are that is capable of being achieved in the prior art gun as shown in FIG. 16. The longer flame length permits the spray operator to maintain a greater distance from the article surface thus reducing reflected heat and reducing operator fatigue. The greatly increased cross-sectional area of the particle matter stream permits more rapid coating of the article surface and reduces the number of passes necessary to coat a given square footage area. This latter reduction in time greatly increases efficiency and further reduces operator fatigue.

It will be appreciated that settings of the regulators 36, 38 and 58 will desirably be varied in accordance with the particular coating requirements, particulate materials, and the like. In particular, it has been found that for materials having relatively low melting points, it is desirable for the propelling air via hose 46 to be delivered at a higher pressure. The reason for this is that the particulate material need not remain in the combustion chamber 99 as long due to its low melting point, and consequently a higher pressure propelling air will have the melted plastic material through the flame "tunnel" as above described more rapidly to avoid burning and the like. Conversely, with respect to high melt point materials, it is desirable to reduce the pressure of propelling air. In this manner, the material will have a longer residence time within the flame "tunnel" so as to permit proper melting of the material before it is applied to the article surface.

Accordingly, for a low melting point material such as polyethylene having an approximate melting point of 222° F., it has been found that the following pressure settings of regulators 36, 38 and 58 are appropriate:

| REGULATOR NUMBER | FLUID TYPE | PRESSURE, PSIG |
|---|---|---|
| 36 | Particle Conveying Air | 1 |
| 38 | Propelling (Flame) Air | 3 |
| 58 | Propane | 4 |

In like manner, for higher melting point materials such as nylon having a nominal melting point of 325° F., the following settings have been found appropriate:

| REGULATOR NUMBER | FLUID TYPE | PRESSURE, PSIG |
|---|---|---|
| 36 | Particle Conveying Air | 5 |
| 38 | Propelling (Flame) Air | 8 |
| 58 | Propane | 10 |

Of course, for thermoplastic materials having different properties, such as melting point and the like, other settings will be necessary.

Numerous variations and modifications may be made in the structure herein described without departing from the present invention. Accordingly, it should be clearly understood that the forms of the invention herein described and shown in the figures of the accompanying drawings are illustrative only and are not intended to limit the scope of the invention.

I claim:

1. A flame spray gun for spraying molten particulate material, comprising:

a body member having distal and proximal ends, said distal end having a planar surface transverse to the centerline of said body member, said body member having a cylindrical bore disposed longitudinally therethrough and communicating with said distal and proximal ends, an annular recessed ring disposed in said distal end planar surface in coaxial relationship to said cylindrical bore for defining a first annular chamber, a first passageway disposed in said body member and communicating with said first annular chamber, a second passageway disposed in said body member and communicating with said cylindrical bore intermediate its length, a material spray nozzle comprising an elongated cylindrical member having an outer diameter less than the diameter of said cylindrical bore and disposed coaxially therein for at least a longitudinal portion thereof, one end of said cylindrical member projecting longitudinally beyond said distal end of said body member for forming a nozzle end, a longitudinal section of said cylindrical member including said nozzle end having an inner diameter increasing over the longitudinal length of said section towards said nozzle end for defining a nozzle tip having an outwardly flaring cross-sectional inner surface configuration over the length of said longitudinal section, the coaxial annular space between the outer wall surface of said cylindrical member and said cylindrical bore disposed in said body member defining a third passageway disposed in said body member, a flame hood assembly adapted for mating attachment with said distal end of said body member, comprising a cylindrical hood section having an open end and a closed end, said hood section including a plurality of circumferentially-spaced apertures disposed radially therethrough and spaced intermediate said open and closed ends, a circular plate forming said closed end of said hood section disposed internally of and transversely to the axis of said cylindrical hood section, the surface of said plate facing said hood section open end forming a first planar surface cooperating with the inner surfaces of said hood section for forming a combustion chamber, the other side of said plate sized to engagingly mate with said distal end face of said body member and forming a second planar surface, and an annular recessed ring disposed in said second planar surface in coaxial alignment with the axis of said hood section for defining a second annular chamber sized to register with said first annular chamber disposed in said distal end face of said body member, said plate having a bore centrally disposed therethrough in coaxial alignment with the axis of said cylindrical hood section and sized to register with said cylindrical bore disposed in said body member distal end and for receiving said projecting nozzle tip of said material spray nozzle, said bore increasing in diameter from the second planar surface to said first planar surface to form a cross-sectional configuration of a truncated cone the larger end of which faces said hood section open end, said plate having a first plurality of spaced orifices disposed therethrough in a first circular pattern coaxial with said central bore and communicating with said second annular chamber, said plate further having a second plurality of spaced orifices disposed therethrough in a second circular pattern coaxial with said central bore and radially spaced outwardly from said first circular pattern, said second plurality of spaced orifices communicating with said second annular chamber, the longitudinal axes of said first and second plurality of spaced orifices defining a pair of concentric annular-shaped patterns coaxially disposed with respect to said hood section axis, means cooperating with said hood section and transverse plate for attaching said hood assembly to said body member distal end with said second annular chamber and bore opening disposed in said plate second planar surface in registering alignment with said first annular chamber and bore opening disposed in said body member distal end planar surface, and a circular diaphragm of a flexible and yieldable material disposed between said body member distal end planar surface and said plate second planar surface for sealing engagement therebetween when said hood section and plate are attached to said body member distal end, said diaphragm having a central aperture therethrough the diameter of which registers with the diameter of said cylindrical bore disposed in said body member and said bore disposed in said plate second planar surface and permitting said nozzle tip to project therethrough, said diaphragm further having a plurality of spaced apertures disposed therethrough in a circular pattern coaxial with said central aperture therethrough and spaced radially therefrom for permitting communication between said body member first annular chamber and said plate second annular chamber, wherein a source of particulate material entrained in a stream of pressurized air is connected to said material spray nozzle cylindrical member for discharge through said nozzle tip in an expanding conically shaped stream coincident with said axis of said cylindrical hood section, wherein a source of pressurized air is connected to said second and said third passageways for discharge through said bore opening in said plate first planar surface in an annular expanding conically-shaped stream concentrically surrounding said stream of particulate material, and wherein a source of a combustible gas is connected to said first passageway for supply to said first annular chamber and through said plurality of diaphragm apertures into said second annular chamber for discharge through said first and second plurality of orifice openings disposed in said plate first planar surface and forming a pair of concentric annular-shaped streams of combustible gas surrounding said concentrically disposed streams of pressurized air and particulate material, said pair of concentric annular-shaped streams of combustible gas intersecting said annular expanding conically-shaped streams of pressurized air within said combustion chamber intermediate said plate and said open end of said hood section for supporting combustion of said gas and forming a generally cylindrically-shaped flame tunnel coaxial of the axis of said hood section and having a diameter at least coincident therewith for accommodating and melting said stream of particulate material therein.

2. The apparatus as described in claim 1, wherein said diaphragm acts to equalize and distribute the gas pressure in said first and second annular chambers by flexing with changes in said pressure occurring in said first annular chamber.

3. The apparatus as described in claim 1, wherein said projecting tip of said nozzle terminates in the plane of said plate first planar surface.

4. The apparatus as described in claim 1, wherein the outwardly projecting angle of said bore disposed in said plate is within the range of 30° to 60° with respect to the horizontal axis of said bore.

5. The apparatus as described in claim 1, wherein the outwardly projecting angle of said flared nozzle tip is within the range of 5° to 15° with respect to the axis of said bore.

6. The apparatus as described in claim 1, further including a spacer attached intermediate the length of said nozzle cylindrical member and projecting radially therefrom for engaging the walls of said cylindrical bore disposed in said body member and maintaining said nozzle cylindrical member in coaxial alignment within said cylindrical bore.

7. The apparatus as described in claim 1, further including:

a hopper for containing a quantity of said particulate material, a source of regulated pressurized air, eductor means cooperating with said hopper and said source of regulated pressurized air for entraining and mixing preselected quantities of said particulate material from said hopper in a stream of said pressurized air for defining said source of said particulate material applied to said material spray nozzle cylindrical member, valve means interposed between said eductor means and said flame spray gun and operable to control the application of said particulate material and pressurized air mixture to said spray gun, and a pilot valve interposed between said source of regulated pressurized air and said eductor means for permitting free flow of said air through said eductor means when said valve means is open and prohibiting flow of said air into said eductor means when said valve means is closed to prohibit blowback of said pressurized air into said hopper when said valve means is closed.

8. The apparatus as described in claim 7, wherein said eductor means comprises:

a member including an inverted conically-shaped receiver for receiving said particulate material from said hopper, a vertically-oriented cylindrical chamber disposed in said member and having an upper open end and a lower closed end, said chamber open end communicating with the inverted apex of said receiver, a cylindrical bore horizontally disposed through said member and intersecting said chamber, one portion of said bore communicating between said pilot valve and said chamber for defining a first passageway in said member, the portion of said bore communicating between said chamber and said valve means for defining a second passageway in said member, and nozzle means disposed in said first passageway in said member and cooperating with said chamber for educing the particulate material from said chamber into said second passageway in said member for entraining the particulate material in said stream of pressurized air flowing therethrough.

9. The apparatus as described in claim 8, wherein said nozzle means comprises an externally threaded elongated cylindrical member adapted for adjustable insertion into said member first passageway, said cylindrical member having a tapered nozzle end insertable transversely through into said chamber and into said second passageway for directing said stream of pressurized air from said pilot valve into said second passageway and lowering the air pressure in said chamber for educting the particulate material from said receiver chamber into said second passageway entrained in said stream of pressurized air.

10. The apparatus as described in claim 7, wherein said valve means comprises a two-position three-way valve and wherein said pilot valve alternate outlet is interconnected to said valve, said valve in a first position permitting the particulate material entrained in said pressurized air to be applied to said flame spray gun and closing said pilot valve alternate outlet, said valve in a second position prohibiting said flow of particulate material entrained in said stream of pressurized gas, but permitting said air from said pilot valve alternate outlet to by-pass said eductor means and be exhausted to said flame spray gun.

11. In a flame spray gun system for spraying molten particulate material including, a hopper for holding a desired quantity of the materials, a source of pressurized air, a mechanism for continuously mixing a desired quantity of the material from the hopper in a conveying air stream for application to the gun and a source of pressurized combustible gas, the improvements of:

a flame spray gun for spraying molten particulate material, comprising:

a body member having distal and proximal ends, said distal end having a planar surface transverse to the centerline of said body member, said body member having a cylindrical bore disposed longitudinally therethrough and communicating with said distal and proximal ends, an annular recessed ring disposed in said distal end planar surface in coaxial relationship to said cylindrical bore for defining a first annular chamber, a first passageway disposed in said body member and communicating with said first annular chamber, a second passageway disposed in said body member and communicating with said cylindrical bore intermediate its length, a material spray nozzle comprising an elongated cylindrical member having an outer diameter less than the diameter of said cylindrical bore and disposed coaxially therein for at least a longitudinal portion thereof, one end of said cylindrical member projecting longitudinally beyond said distal end of said body member for forming a nozzle end, a longitudinal section of said cylindrical member including said nozzle end having an inner diameter increasing over the longitudinal length of said section towards said nozzle end for defining a nozzle tip having an outwardly flaring cross-sectional inner surface configuration over the length of said longitudinal section, the coaxial annular space between the outer wall surface of said cylindrical member and said cylindrical bore disposed in said body member defining a third passageway disposed in said body member, a flame hood assembly adapted for mating attachment with said distal end of said body member, comprising a cylindrical hood section having an open end and a closed end, said hood section including a plurality of circumferentially-spaced apertures disposed radially therethrough and spaced intermediate said open and closed ends, a circular plate forming said closed end of said hood section disposed internally of and transversely to the axis of said cylindrical hood section, the surface of said plate facing said hood section open end forming a first planar surface cooperating with the inner surfaces of said hood section for forming a combustion chamber, the other side of said plate sized to engagingly mate with said distal end face of said body member and forming a second planar surface, and an annular recessed ring disposed in said second planar surface in coaxial alignment with the axis of said hood section for defining a second annular chamber sized to register with said first annular chamber disposed in said distal end face of said body member, said plate having a bore centrally disposed therethrough in coaxial alignment with the axis of said cylindrical hood section and sized to register with said cylindrical bore disposed in said body member distal end and for receiving said projecting nozzle tip of said material spray nozzle, said bore increasing in diameter from the second planar surface to said first planar surface to form a cross-sectional configuration of a truncated cone the larger end of which faces said hood section open end, said plate having a first plurality of spaced orifices disposed therethrough in a first circular pattern coaxial with said central bore and communicating with said second annular chamber, said plate further having a second plurality of spaced orifices disposed therethrough in a second circular pattern coaxial with said central bore and radially spaced outwardly from said first circular pattern, said second plurality of spaced orifices communicating with said second annular chamber, the longitudinal axes of said first and second plurality of spaced orifices defining a pair of concentric annular-shaped patterns coaxially disposed with respect to said hood section axis, means cooperating with said hood section and transverse plate for attaching said hood assembly to said body member distal end with said second annular chamber and bore opening disposed in said plate second planar surface in registering alignment with said first annular chamber and bore opening disposed in said body member distal end planar surface, and a circular diaphragm of a flexible and yieldable material disposed between said body member distal end planar surface and said plate second planar surface for sealing engagement therebetween when said hood section and plate are attached to said body member distal end, said diaphragm having a central aperture therethrough the diameter of which registers with the diameter of said cylindrical bore disposed in said body member and said bore disposed in said plate second planar surface and permitting said nozzle tip to project therethrough, said diaphragm further having a plurality of spaced apertures disposed therethrough in a circular pattern coaxial with said central aperture therethrough and spaced radially therefrom for permitting communication between said body member first annular chamber and said plate second annular chamber, wherein the particulate material entrained in the stream of pressurized conveying air is connected to said material spray nozzle cylindrical member for discharge through said nozzle tip in an expanding conically shaped stream coincident with said axis of said cylindrical hood section, wherein the source of pressurized air is connected to said second and said third passageways for discharge through said bore opening in said plate first planar surface in an annular expanding conically-shaped propelling stream concentrically surrounding said stream of particulate material, and wherein the source of a combustible gas is connected to said first passageway for supply to said first annular chamber and through said plurality of diaphragm apertures into said second annular chamber for discharge through said first and second plurality of orifice openings disposed in said plate first planar surface and forming a pair of concentric annular-shaped streams of combustible gas surrounding said concentrically disposed streams of propelling air and particulate material in conveying air, said pair of concentric annular-shaped streams of combustible gas intersecting said annular expanding conically-shaped streams of air within said combustion chamber intermediate said plate and said open end of said hood section for supporting combustion of said gas and forming a generally cylindrically-shaped flame tunnel coaxial of the axis of said hood section and having a diameter at least coincident therewith for accommodating and melting said stream of particulate material therein.

12. The apparatus as described in claim 11, wherein said diaphragm acts to equalize and distribute the gas pressure in said first and second annular chambers by flexing with changes in said pressure occurring in said first annular chamber.

13. The apparatus as described in claim 11, wherein said projecting tip of said nozzle terminates in the plane of said plate first planar surface.

14. The apparatus as described in claim 11, wherein the outwardly projecting angle of said bore disposed in said plate is within the range of 30° to 60° with respect to the axis of said bore.

15. The apparatus as described in claim 11, wherein the outwardly projecting angle of said flared nozzle tip within the range of 5° to 15° with respect to the axis of said bore.

16. The apparatus as described in claim 11, further including a spacer attached intermediate the length of said nozzle cylindrical member and projecting radially therefrom for engaging the walls of said cylindrical bore disposed in said body member and maintaining said nozzle cylindrical member in coaxial alignment within said cylindrical bore.

17. The improved apparatus as described in claim 11, further including:

a hopper for containing a quantity of the particulate material, eductor means cooperating with said hopper and the source of pressurized air for entraining and continuously mixing preselected quantities of said particulate material from said hopper in a stream of said pressurized conveying air for defining the source of said particulate material applied to said material spray nozzle cylindrical member, valve means interposed between said eductor means and said flame spray gun and operable to control the application of said particulate material and conveying air mixture to said spray gun, and a pilot valve interposed between said source of regulated pressurized air and said eductor means for permitting free flow of said air through said eductor means when said valve means is open and prohibiting flow of said air into said eductor means when said valve means is closed to prohibit blowback of said pressurized air into said hopper when said valve means is closed.

18. The apparatus as described in claim 17, wherein said eductor means comprises:

a member including an inverted conically-shaped receiver for receiving said particulate material from said hopper, a vertically-oriented cylindrical chamber disposed in said member and having an upper open end and a lower closed end, said chamber open end communicating with the inverted apex of said receiver, a cylindrical bore horizontally disposed through said member and intersecting said chamber, one portion of said bore communicating between said pilot valve and said chamber for defining a first passageway in said member, the portion of said bore communicating between said chamber and said valve means for defining a second passageway in said member, and nozzle means disposed in said first passageway in said member and cooperating with said chamber for educing the particulate material from said chamber into said second passageway in said member for entraining the particulate material in said stream of pressurized conveying air flowing therethrough.

19. The apparatus as described in claim 18, wherein said nozzle means comprises an externally threaded elongated cylindrical member adapted for adjustable insertion into said member first passageway, said cylindrical member having a tapered nozzle end insertable transversely through into said chamber and into said second passageway for directing said stream of pressurized air from said pilot valve into said second passageway and lowering the air pressure in said chamber for educting the particulate material from said receiver chamber into said second passageway entrained in said stream of pressurized conveying air.

20. The apparatus as described in claim 17, wherein said valve means comprises a two-position three-way valve and wherein said pilot valve alternate outlet is interconnected to said valve, said valve in a first position permitting the particulate material entrained in said conveying air to be applied to said flame spray gun and closing said pilot valve alternate outlet, said valve in a second position prohibiting said flow of particulate material entrained in said stream of conveying air, but permitting said air from said pilot valve alternate outlet to by-pass said eductor means and be exhausted to said flame spray gun.

21. A method for spraying molten particles, comprising the steps of:

establishing a central flow of particulate material entrained in a stream of conveying air having a radially expanding conically-shaped cross-section along a longitudinal axis, establishing an annular flow of pressurized propelling air having a radially expanding conically-shaped cross-section and concentrically enveloping said central flow of particulate material and conveying air, establishing a first annular flow of combustible gas having a cylindrical-shaped cross-section and concentrically enveloping said flows of pressurized propelling air and conveying air carrying said particulate material, establishing a second annular flow of combustible gas radially spaced about said first annular flow of said gas and having a cylindrically-shaped cross-section for concentrically enveloping said first annular gas flow and said flows of pressurized propelling air and conveying air carrying said particulate material, wherein said radially expanding flows of propelling air and conveying air carrying said particulate material intersect and mix with said pair of concentric cylindrical flows of combustible gas, establishing an annular flow of ambient atmospheric air generally concentric to and radially enveloping said first and second flows of combustible gas; igniting said gas and air mixture to obtain an elongated generally annular flame tunnel for enveloping and heating said flow of particulate material therethrough and melting the particles therein.

22. The method of claim 21, wherein the step of establishing a central flow of conveying air and particulate material includes establishing the angle of said radially expanding conically-shaped flow with respect to said longitudinal axis within a range of about 30° to 60°.

23. The method of claim 21, wherein the step of establishing an annular flow of propelling air includes establishing the angle of said radially expanding conically-shaped flow with respect to said longitudinal axis within a range of about 5° to 15°.

* * * * *